US011041329B2

(12) United States Patent
Schiffer et al.

(10) Patent No.: US 11,041,329 B2
(45) Date of Patent: Jun. 22, 2021

(54) CLOSING DEVICE FOR A MOTOR VEHICLE HOOD

(71) Applicant: Kiekert Aktiengesellschaft, Heiligenhaus (DE)

(72) Inventors: Holger Schiffer, Meerbusch (DE); Michael Scholz, Essen (DE)

(73) Assignee: Kiekert AG, Heiligenhaus (DE)

( * ) Notice: Subject to any disclaimer, the term of this patent is extended or adjusted under 35 U.S.C. 154(b) by 997 days.

(21) Appl. No.: 15/323,212

(22) PCT Filed: Jun. 30, 2015

(86) PCT No.: PCT/DE2015/000328
§ 371 (c)(1),
(2) Date: Dec. 30, 2016

(87) PCT Pub. No.: WO2016/000674
PCT Pub. Date: Jan. 7, 2016

(65) Prior Publication Data

US 2017/0159330 A1 Jun. 8, 2017

(30) Foreign Application Priority Data

Jun. 30, 2014 (DE) ..... 10 2014 109 110.8

(51) Int. Cl.
*E05B 77/08* (2014.01)
*E05B 83/24* (2014.01)

(52) U.S. Cl.
CPC ..... *E05B 77/08* (2013.01); *E05B 83/24* (2013.01)

(58) Field of Classification Search
CPC ..... E05B 77/08; E05B 83/24
USPC ..... 292/DIG. 14, DIG. 22
See application file for complete search history.

(56) References Cited

U.S. PATENT DOCUMENTS

2006/0170224 A1* 8/2006 Mitchell ..... E05B 83/24 292/216

FOREIGN PATENT DOCUMENTS

| | | | |
|---|---|---|---|
| DE | 102005016186 | A1 | 10/2006 |
| DE | 102008025604 | A1 | 12/2009 |
| DE | 102010025355 | A1 | 12/2011 |
| FR | 2 863 298 | A1 | 6/2005 |

(Continued)

OTHER PUBLICATIONS

International Search Report and Written Opinion for corresponding Patent Application No. PCT/DE2015/000328 dated Nov. 25, 2015.

*Primary Examiner* — Kristina R Fulton
*Assistant Examiner* — Thomas L Neubauer
(74) *Attorney, Agent, or Firm* — Renner, Otto, Boisselle & Sklar, LLP

(57) ABSTRACT

The invention relates to a closing device for a door or flap, in particular for a door or flap of a motor vehicle, comprising a locking mechanism that consists of a rotary latch (1) and at least one pawl (2) for locking the rotary latch (1) and an impact protection element, said impact protection element being moved out of its protecting position when the door or flap is closed at a speed below a threshold value and the impact protection element not being moved out of is protecting position or only being moved out with a certain delay when the door or flap is closed at a speed above a threshold value. In this manner, any damage caused by an impact can be avoided in a technically simple manner.

13 Claims, 6 Drawing Sheets

(56) References Cited

FOREIGN PATENT DOCUMENTS

Figure 1:
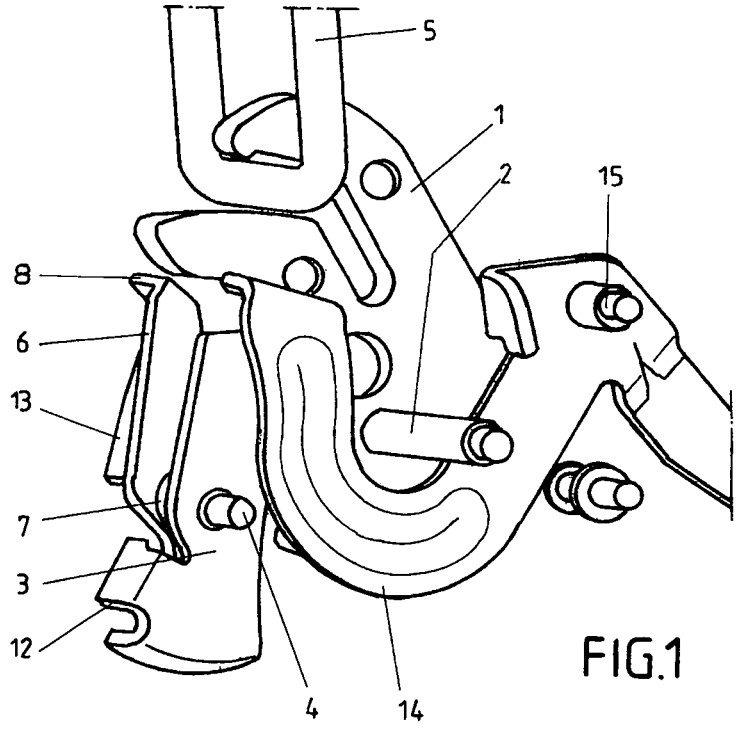

| | | |
|---|---|---|
| WO | WO 2012/100328 A1 | 8/2012 |
| WO | WO 2015/139678 A1 | 9/2015 |

* cited by examiner

CLOSING DEVICE FOR A MOTOR VEHICLE HOOD

The invention relates to a latching device with a latch for a door or a flap and in particular for a hood of a motor vehicle with a locking mechanism. A locking mechanism comprises a catch and at least a pawl for latching of the catch. The latching device encompasses an impact protector in order to prevent mechanical damage.

The purpose of a latch or latching device of the type initially stated is for the temporary closure of openings in motor vehicles with the aid of doors or flaps. In the closed state of such a latch the catch grasps a bracket-shaped locking bolt in particular with two arms. If the catch of such a latch reaches a closed position by means of pivoting starting in an open position, the catch is ultimately ratcheted by means of the pawl. Such a pivoting is attained by the locking bolt (also referred to as "latch holder" or "latch bracket") when it engages into the catch by closure of a pertaining door or flap.

If a door or flap is closed at great speed, the locking bolt impacts the catch with great force. Damage due to such an impact can be prevented by an impact protector. An impact protector, which can, for example, be a pivotable lever connected to the chassis, intercepts the forces initiated by the impact and deflects these into the chassis, for example, in order to prevent damage. Following an impact, the impact protector is moved out of its protective position in order to enable pivoting of the catch into its ratchet position and thus ratcheting of the locking mechanism. The impact protector can be moved out of its protective position by an electrical drive and mechanism.

The task of the invention is to further develop a latching device with an impact protector.

The task is solved by a latching device with the characteristics of the first claim. Advantageous designs arise from the sub claims. Unless stated to the contrary hereafter, the aforementioned characteristics known from the state of the art can be combined individually or in any combination with the object according to the invention.

In order to solve the task, a latching device for a door or flap is provided, in particular for a door or flap of a motor vehicle. There is a locking mechanism comprising a catch and at least a pawl for latching of the catch and an impact protector. The impact protector is moved out of its protective position when the door or flap is closed at sufficiently low speed. When a specified speed is exceeded, the impact protector is not moved or is moved in a delayed manner out of its protective position. It then intercepts an impact in order to prevent damage.

In the case of sufficiently low closure speed of a door or flap, an impact protector is not necessary. This is therefore preferably moved out of its protective position in good time, in particular before the catch or another provided component, which can be decelerated or blocked by the impact protector on which the impact protector can strike. The locking mechanism can thus be ratcheted in a delay-free manner without needing to move the impact protector subsequently out of its protective position following striking of the catch on the impact protector. The impact protector therefore unfolds its protective effect advantageously in this design only if a door or flap is closed at excessively high speed, i.e. at a speed above a threshold value.

If the impact protector moves out of its protective position in a time-delayed manner in one design by excessively quick closure of a door or a flap, it is advantageously not necessary to initially move or lift the door or flap back somewhat in the opening direction in order to be able to close a door or flap. In this design, the impact protector has a type of braking effect, i.e. it cannot permanently block or only temporarily delay the closure movement.

In one design of the invention, the impact protector remains in its protective position when the door or flap has been closed at an excessively high speed. The door or flap then needs to be opened or lifted somewhat again and subsequently closed again with sufficiently low speed, i.e. a speed below the threshold value, in order to be able to ratchet the locking mechanism. This design prevents technically elaborate construction as no mechanism needs to be provided in addition to the drive in order to subsequently move the impact protector out of its protective position following an impact.

In one design of the invention, a drive can be provided which moves the impact protector out of its protective position using a mechanism after it has intercepted an impact. However, this design is technically more elaborate and is therefore not preferable.

In one design of the invention, an electrical drive can be provided in addition to a mechanism in order to move the impact protector out of its protective position when a door or flap is closed at sufficiently low speed. The closure speed can be ascertained with a sensor, for example, and the behavior of the impact protector controlled dependent thereon. However, a purely mechanical solution is to be preferred which manages without a sensor or an electrical drive. A purely mechanical solution can firstly be provided in a technically simple manner. As such, a purely mechanical solution does not rely on the functioning of a sensor and the functioning of an electrical drive and thus on the functioning of a multitude of components, a purely mechanical solution is especially durable and reliable.

In one design, the purely mechanical solution comprises a control lever for the impact protector on which the catch or another suitable component strikes before the catch or the other component can reach the impact protector. If the catch is moved further in the direction of the ratchet position following striking, the control lever is thereby directly or indirectly moved out of its initial position. If this happens at sufficiently low speed, the control lever moves the impact protector out of its protective position. In the case of exceeding a specified speed, i.e. at excessively high speed, the control lever then does not move the impact protector or moves it in a time-delayed manner out of its protective position in such a way that the impact protector is capable of absorbing an impact. For example, the catch and/or the locking bolt can reach the control lever by a closure of the door or flap in order to pivot it to control the impact protector.

In order to cause this, in one design the control lever is connected to the impact protector with an especially pre-tensioned spring. The pre-tensioned spring is pre-tensioned and dimensioned in such a way that the impact protector and the control lever behave like a rigid body in the case of a sufficiently low speed. When a specified speed is exceeded, i.e. at an excessively high speed, the control lever is pivoted relative to the impact protector on the contrary. The impact protector is then not moved or not moved sufficiently quickly out of its protective position if the door or flap is closed at an excessively high speed so that the impact protector is capable of absorbing and suitably deflecting impact forces.

In one design of the invention, the impact protector is a pivotable blocking lever which is generally attached in principle to a metal plate. The plate can be part of the chassis or attached to the chassis in order to deflect impact forces into the chassis and protect it from damage.

In one design, the control lever is pivotably located and in a technically especially simple execution form preferably by the axis by means of which the impact protector is pivotably located. However, the control lever can be pivotably attached to the impact protector by a further axis.

In one design of the invention, the impact protector advantageously demonstrates a larger mass than the control lever. This contributes to being able to attain the desired movement process with particular ease by mass inertia and/or gravity.

In one design of the invention, the catch directly impacts on the impact protector if this has not been moved out of its protective position. This design is technically especially simple. However, a further component can be provided which impacts. For example, the locking bolt can alternatively or additionally impact on the impact protector directly when the door or flap is closed at excessively high speed.

In a technically simple design of the invention, the impact protector is advantageously moved purely mechanically, thus for example by a pre-tensioned spring and/or by gravity into its protective position and/or held in its protective position. In order to move the impact protector out of its protective position, this must occur against the force of the pre-tensioned spring and/or against gravity. This design ensures reliable and durable functioning.

The invention relates in particular to flaps or hoods which can impact to behind a main ratchet position. The possibility of the impact is for passive safety in the case of a crash in order to provide better protection for occupants in the case of an impact on the hood. If a person impacts the hood or flap, the catch can be further rotated in such a way that the hood or flap buckles and thus reduces the risk of injury. In particular, on such hoods or flaps there is the problem that damage can occur to the paintwork, chassis, headlights and add-on components with a lack of impact protection in the case of excessively quick closure of the hood or flap. In order to prevent this, such a hood is previously blocked or decelerated by the impact protector, preferably by at least 6 mm, before the hood or flap has attained its closed position. If no gap remains between the hood or flap in the normal closed state (so-called 0 gap), the impact protector preferably brakes or blocks at least 12 mm before attainment of the closed state of the hood or flap. The hood or flap therefore then needs to be lowered at least 6 mm or at least 12 mm further in order to reach its normal closed position from the braked or blocked position.

The proposed solution is based on a mass locking device which preferably consists of two levers, namely a blocking lever and a control lever. In the basic position, the blocking lever takes the control lever along in particular by means of a stop or vice versa. In the case of activation of the control lever, it takes along the blocking lever by means of the spring at least if closure takes place at sufficiently low speed.

If the control lever is activated at high speed, the blocking lever is not taken along or only taken along in a delayed manner due to its inertia. Due to the spring moment and the inertia of the blocking lever, the taking along of the blocking lever can be stopped. A prevented or time-delayed taking along is used for blocking or braking. If the control lever is moved slowly, the blocking lever moves synchronously to the control lever.

After a blockade, in one design a spring-stressed ejector lever for example lifts the hood slightly, the blocking lever is relieved and the hood can then be slowly closed in an advantageous design electromechanically, i.e. with the involvement of an electrical drive. Such an optionally provided electrical drive advantageously ensures that the hood is ultimately closed sufficiently slowly. The electrical drive can suitably lower an ejector lever in due course in order to slowly close the flap. For this purpose, the locking bolt or locking bracket of the hood can for example lie on the ejector lever at a suitable time due to gravity.

The blocking lever can directly block or brake the ejector lever in one design and thus indirectly block or brake the catch. However, other components can also be directly blocked such as catch, locking bolt or hood. The control lever is preferably directly activated by the catch. However, the control lever can also be activated by the ejector lever, the locking bolt or the hood. It is therefore not necessary for the control lever to be activated by the catch.

In one design, the latching device comprises a control arm which is pivoted in such a way during closure of a pertaining door or flap that the impact protector can move out of its protective position. The control arm ultimately releases the impact protector. If, due to the inertia, the impact protector cannot be moved out of its protective position quickly enough, the impact protector thus intercepts the locking bolt, whereby damage is prevented.

The control arm is preferably part of the pawl of the locking mechanism in order to thus minimize the number of components and enable a compact design.

The control arm is preferably outside of the plane within which the catch can be rotated in order to enable a compact design. The catch can be moved past the control arm which enables plunging of the catch, even with a compact design.

With the blocking lever, the control arm principally includes a right angle when the locking mechanism is open. Thus, but also due to a preferably extended design of the control arm, the control arm can very quickly release the blocking lever in due course in order to be able to open it in as delay-free a manner as possible.

There is preferably a pre-tensioned spring which is capable of moving the impact protector out of its protective position. The impact protector can thus be moved out of its protective position in a mechanical and therefore simple manner.

In one design, the catch is initially adjacent to the pawl during closure and ultimately releases the pawl in such a way that the pawl can be pivoted into its ratchet position. This contributes to further minimizing the number of components. This enables a compact design.

In one design, the catch and preferably an arm of the catch is adjacent to a control contour of the pawl in order to thus suitably control the movement sequence simply and reliably.

In one design, the control contour is formed by a protrusion. After the catch has suitably passed the protrusion, the pawl can be pivoted. This enables ratcheting of the locking mechanism in a technically simple manner. Pivoting of the pawl ultimately enables in particular the impact protector to be moved out of its protective position. This also contributes to attaining the desired movement sequence with a low number of components.

A hood latch arresting hook is preferably present which needs to be pivoted after unratcheting of the locking mechanism in order to be able to open a pertaining door or flap. In particular in the case of a hood, the opening of a hood in an unscheduled manner, for example, is advantageously prevented in the case of failure of the locking mechanism formed of a catch and a pawl.

The impact protector and the hood latch arresting hook are preferably pivotably located by a common axis in order to keep the number of components low and enable a compact design.

The hood latch arresting hook is pivoted backwards and forwards during latching by the locking bolt in one design. Thus, an impact can be advantageously reduced at increased closure speed.

Due to the invention, a mechanical hood latch system with an arresting hook can be provided which permits plunging of the closed hood (SH) of preferably at least 10 mm, especially preferably at least 15 mm in order to retain increased pedestrian protection. The hood latch can always latch in the main ratchet in daily operation. The locking bolt can only be moved so far beyond the main ratchet to enable the pawl to engage into its ratchet position. To prevent damage to the hood, the hood cannot deflect in the case of excessive closure speed.

Deflection of the hood is prevented in particular by a blocking lever. It enables the locking bolt sufficient play for the pawl to engage into the ratchet position in the main ratchet and prevents the system from deflecting. If the system is closed, the blocking lever has left its position and plunging of the locking bolt is possible.

In one design, the blocking lever is adjacent to the pawl in a spring-loaded manner. It maintains its position dependent on the pawl. If the pawl moves slowly, the blocking lever moves slowly behind and releases a plunging area. At high speed of the pawl, the blocking lever cannot be in direct pursuit due to its inertia and it prevents a plunging of the locking bolt. When the system is at rest again, the blocking lever pivots the pawl subsequently and releases the plunging area. It is a speed-dependent system.

The invention is explained in further detail hereafter on the basis of two execution examples.

Figure 2:
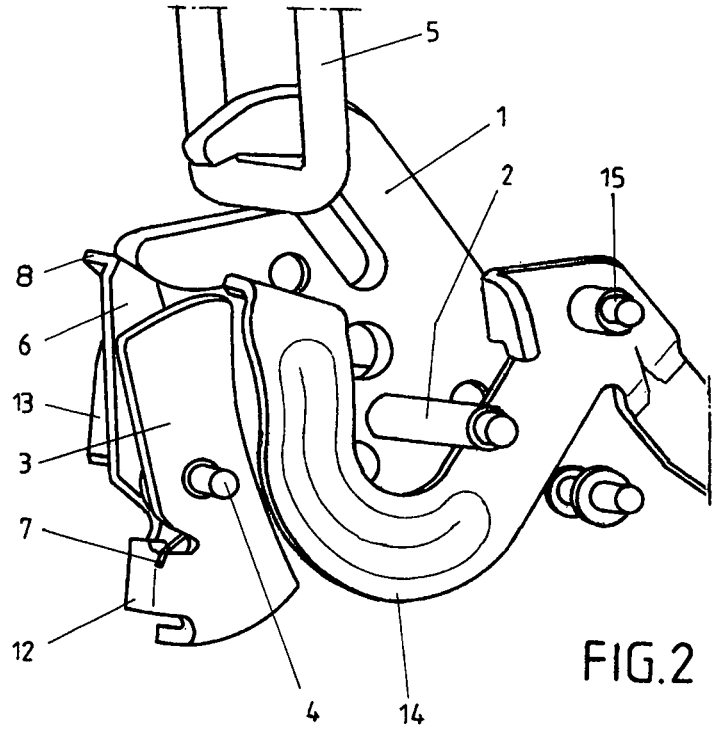
Figure 3:
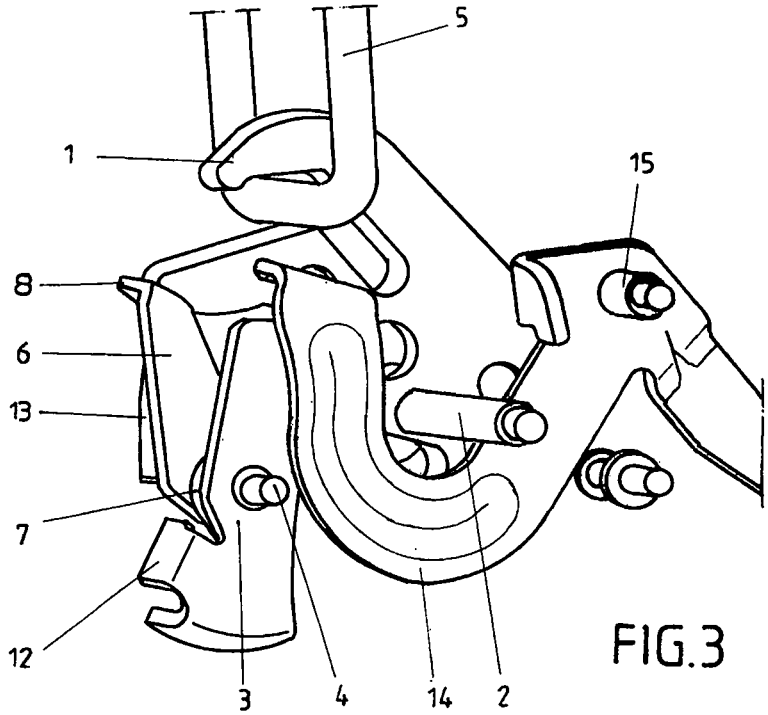
Figure 4:
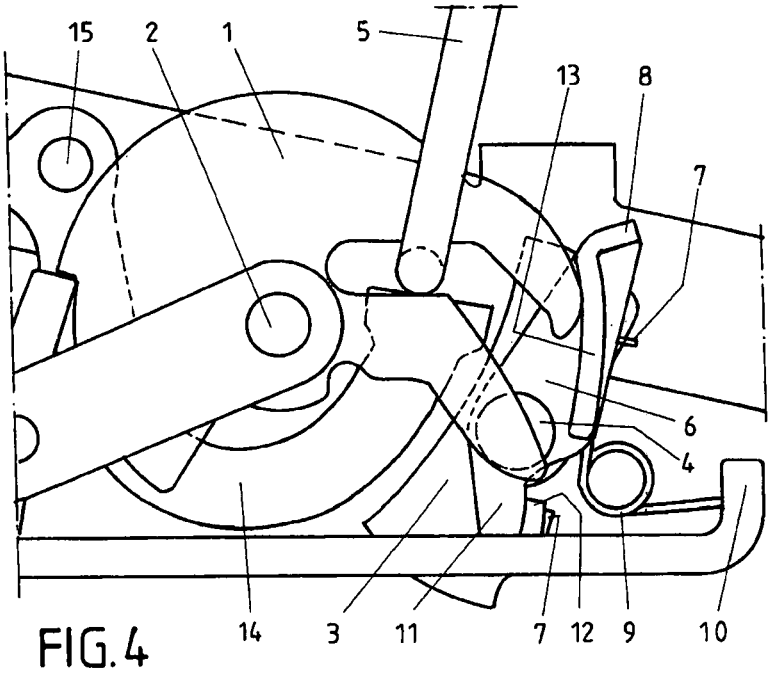
Figure 6:
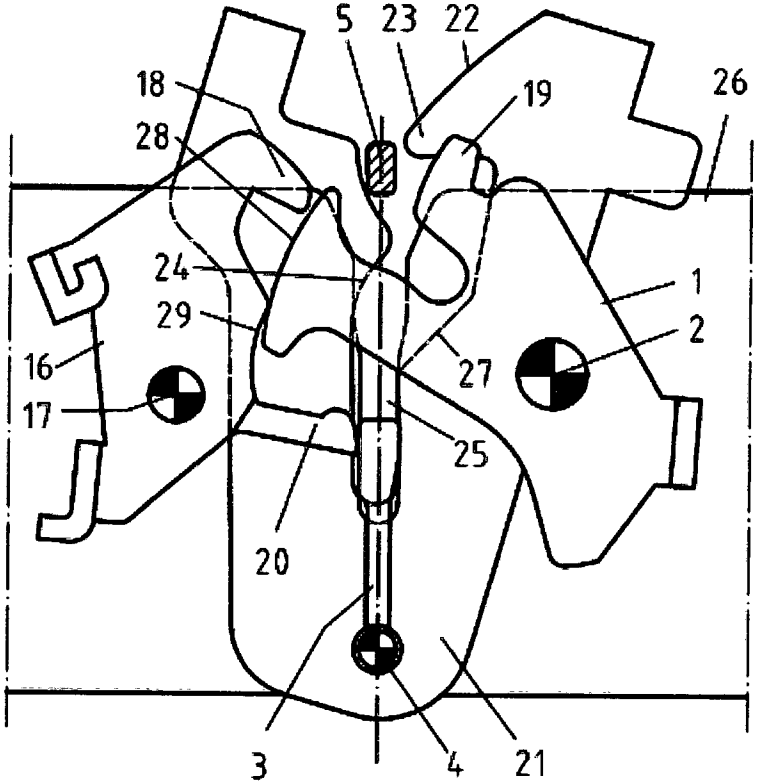
Figure 5:
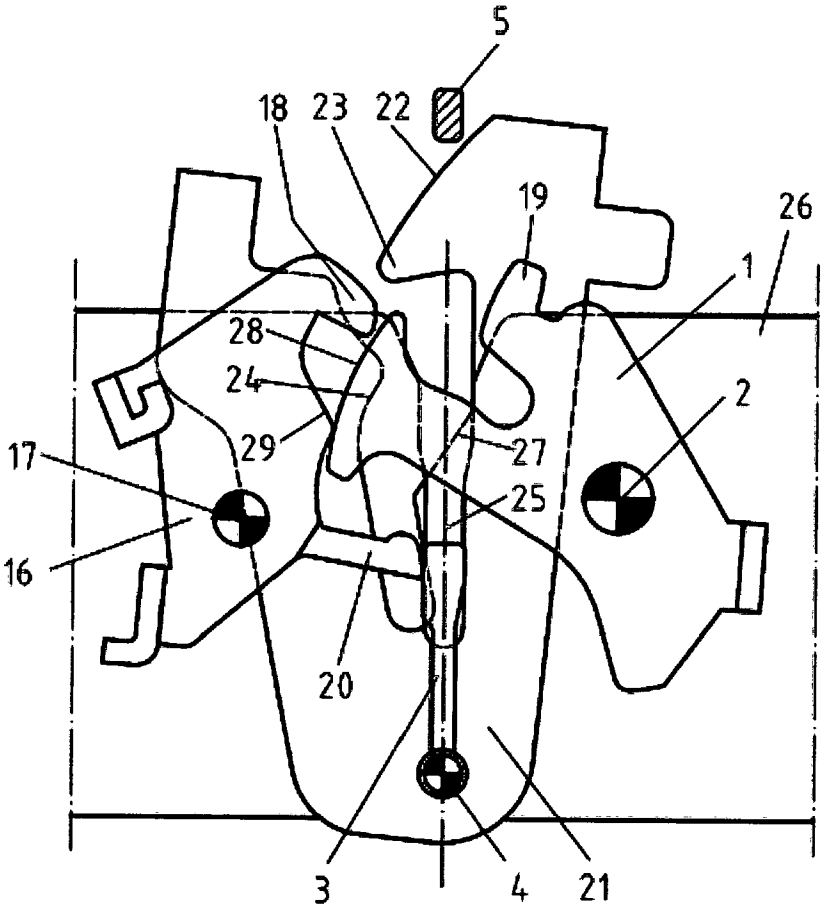
Figure 8:
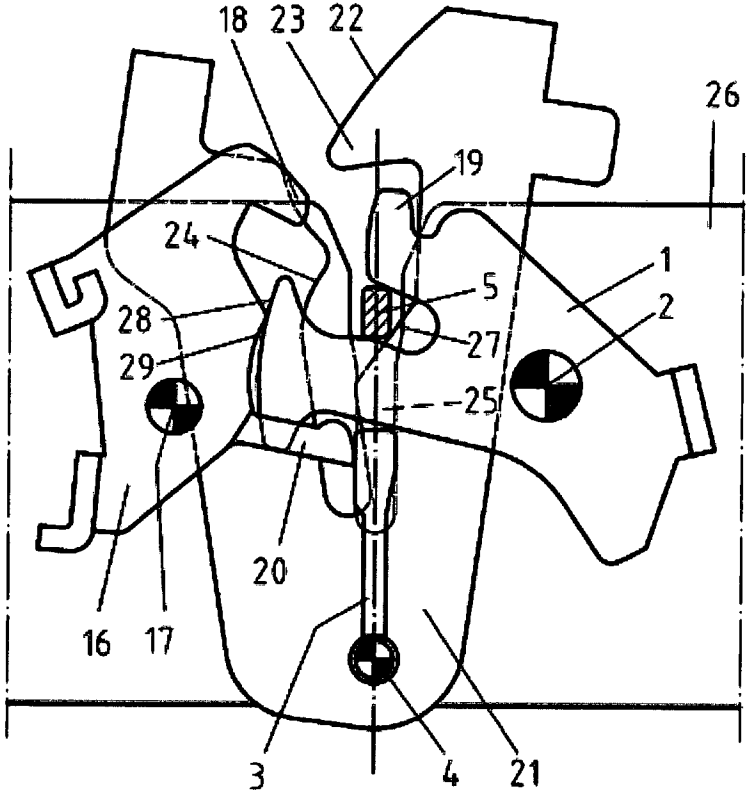
Figure 7:
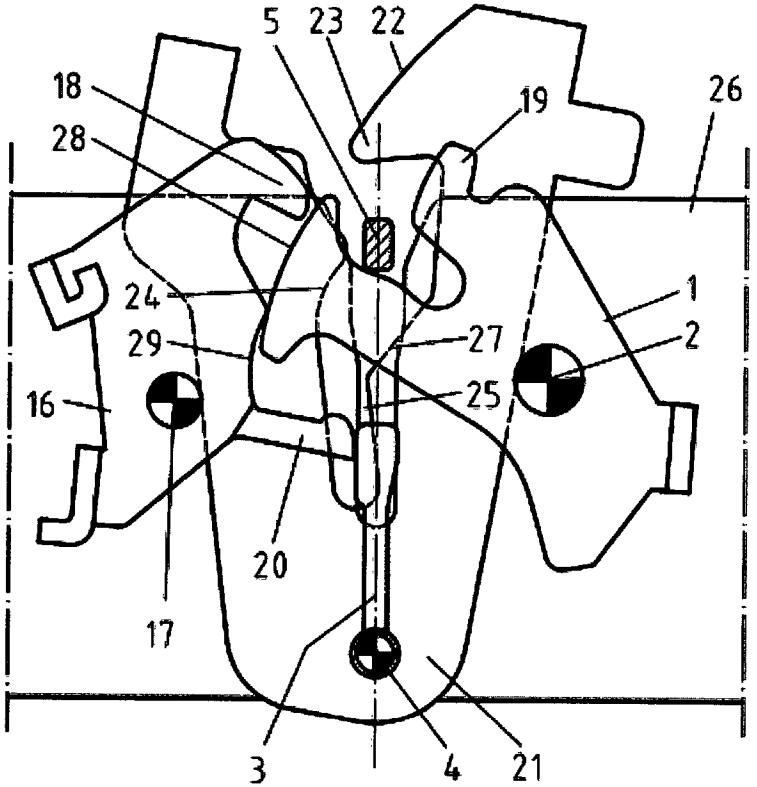
Figure 10:
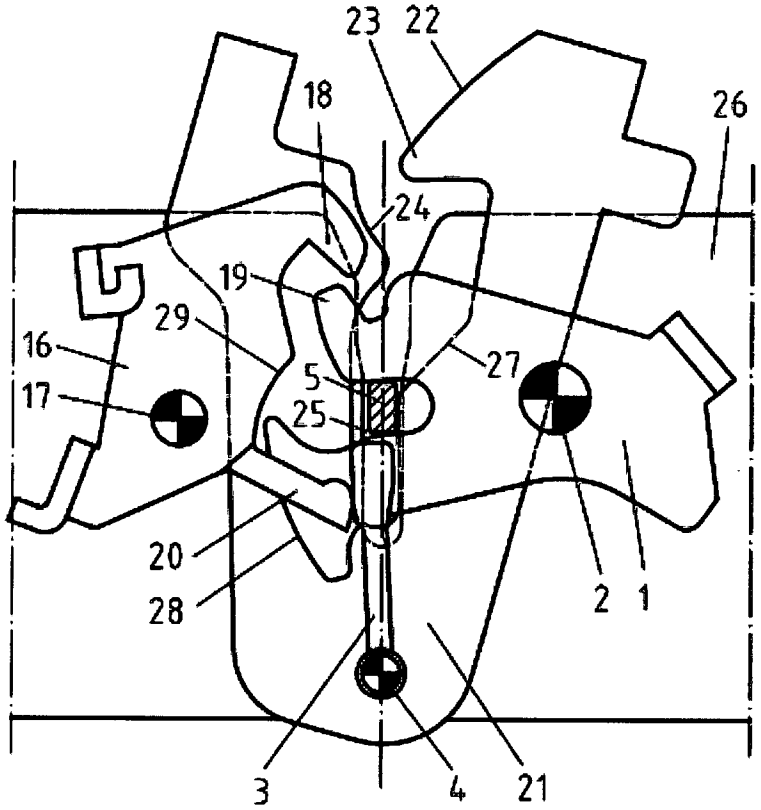
Figure 9:
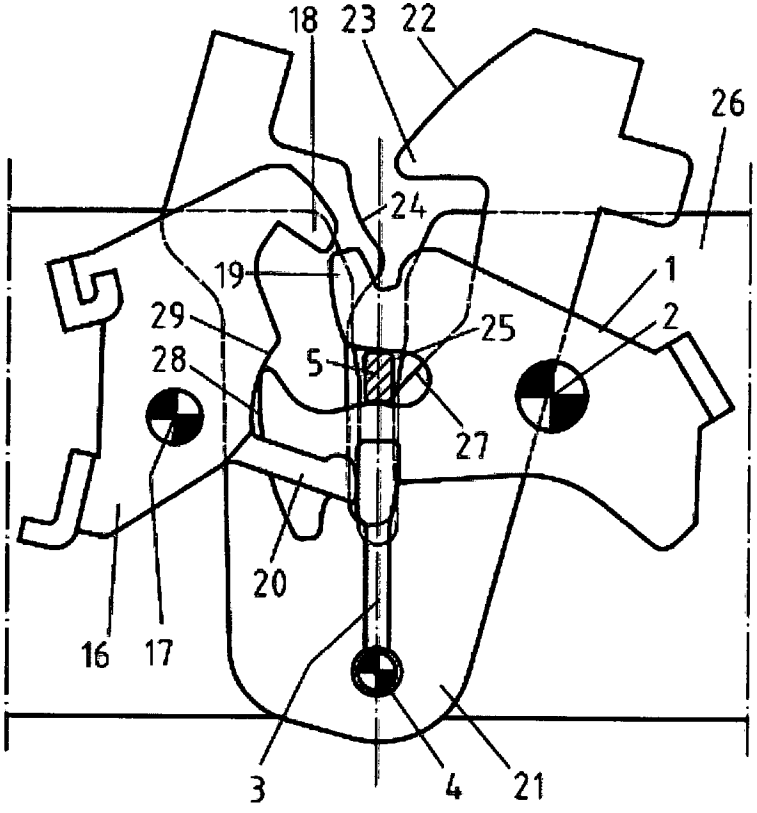
Figure 12:
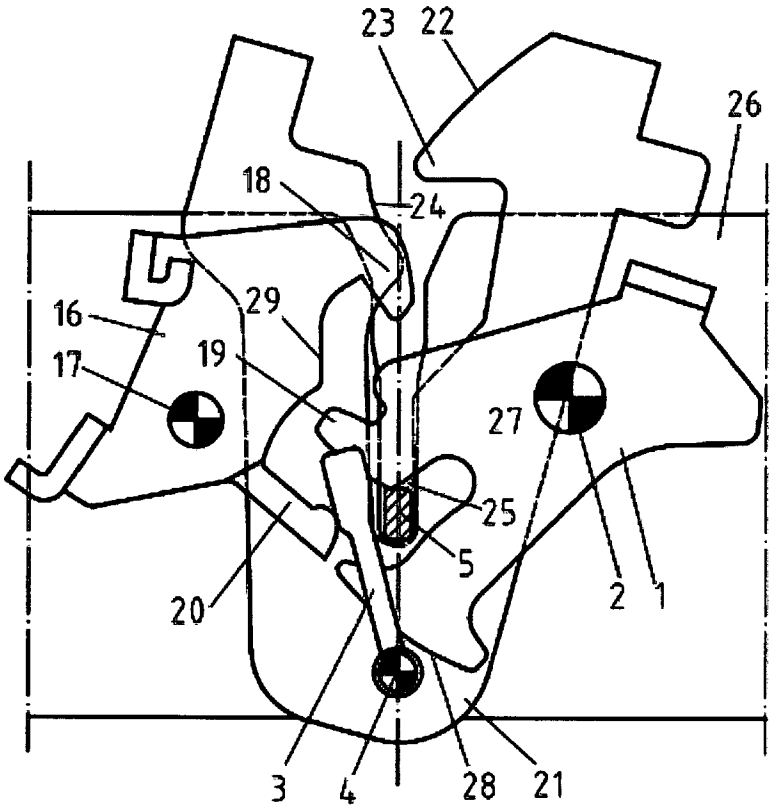
Figure 11:
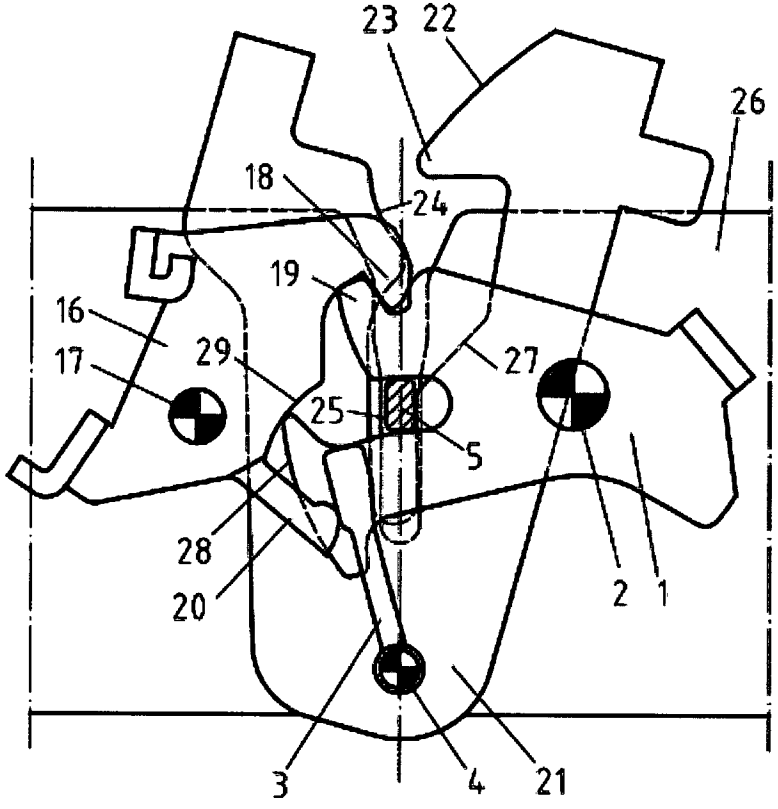

The following are shown:

FIG. 1: Locking mechanism during closure before striking of the catch on a control lever;

FIG. 2: Locking mechanism during closure after striking of the catch on a control lever at low speed;

FIG. 3: Locking mechanism during closure after striking of the catch on a control lever at high speed;

FIG. 4: Locking mechanism with catch in the main ratchet position;

FIG. 5: Open locking mechanism;

FIG. 6: Locking mechanism during closure of the hood;

FIG. 7: Locking mechanism during closure of the hood;

FIG. 8: Locking mechanism during closure of the hood;

FIG. 9: Locking mechanism during closure of the hood;

FIG. 10: Locking mechanism during closure of the hood;

FIG. 11: Locking mechanism ratcheted in the main ratchet;

FIG. 12: Locking mechanism with catch in overstroke position.

FIGS. 1 to 3 show a perspective view of a catch 1 of a locking mechanism which is pivotably located on a non-illustrated plate by its axis 2. A blocking lever 3 with a great mass (compared to the control lever 6) is pivotably located on a non-illustrated plate by its axis 4 and forms an impact protector for the catch when a door or flap is closed at excessively high speed.

A locking bolt 5 is illustrated which is attached to a non-illustrated hood.

A control lever 6 is pivotably located on the axis 4. The control lever 6 and impact protector or blocking lever 3 are connected via a pre-tensioned spring 7. The spring 7 is held by the axis 4. A leg of the pre-tensioned spring 7 is adjacent to a vertically protruding flap 12 of the blocking lever 3. The other leg is pre-tensioned on the control lever 6. The common center of gravity of the control lever 6 and the blocking lever 3 is preferably located in such a way below the axis 4 that the blocking lever 3 moves by gravity into its protective position shown in FIG. 1 and can be moved here by gravity. Alternatively or additionally, a pre-tensioned spring 9 can exist (shown in FIG. 4) which jointly moves the control lever 6 and the blocking lever 3 into the protective position and can maintain it here.

FIG. 1 shows the start of a closure process. The locking bolt 5 is moved into the infeed section of the catch 1 by closure of a non-illustrated hood. Starting from its open position, the catch 1 has thus been pivoted in the direction of the main ratchet position, but has not yet reached the control lever 6.

If the door or flap is further closed, the locking bolt 5 pivots the catch 1 further around its axis 2 in the direction of the main ratchet position and in the case of FIGS. 1 to 3 in an anti-clockwise direction. Thus, the catch 1 reaches the free end 8 of the control lever 6. The free end 8 of the control lever 6, onto which the catch 1 strikes with an arm of the fork-shaped inlet slit is designed in a beveled or ramp-like manner, such that following such a striking the catch 1 pivots the control lever 6 around the axis 4 in an anti-clockwise direction. If this occurs at sufficiently low speed, the control lever 6 and the blocking lever 3 behave at least principally like a rigid body due to connection by means of the spring 7 and are therefore pivoted jointly around the axis 4 in an anti-clockwise direction, as illustrated by the comparison of FIGS. 1 and 2. The blocking lever 3 thus leaves its protective position. Consequently, the catch 1 can then be pivoted further in the direction of the ratchet position in order to be ultimately ratcheted by a non-illustrated pawl.

If, on the contrary, the catch 1 is pivoted excessively quickly, the control lever 6 and the blocking lever 3 do not behave like a rigid body. This is prevented by the inertia of the mass of the blocking lever 3. Then only the control lever 6 is pivoted around the axis 4 in an anti-clockwise direction as depicted in FIG. 3. The blocking lever 3 remains in its protective position as shown in FIG. 3. The locking bolt 5 will then strike the free end with the bent-off flap of the ejector lever 14 and pivot it around its axis 15 in an anti-clockwise direction. The pivoting movement of the ejector lever 14 is blocked as soon as the bent-off flap strikes the blocking lever 3. The associated impact forces are subsequently introduced into the plate to which the blocking lever 3 is attached.

The ejector lever in the case of FIG. 4 is preferably pivoted against the force of a pre-tensioned, non-illustrated spring in the direction of the blocking lever 3. Thus, the closure speed of the hood is already decelerated and the impact on the blocking lever 3 thus advantageously reduced. It is thus further attained that following the blockage the hood is lifted again somewhat by the spring force in order to attain and ensure that the blocking lever is reliably moved out of its blocking position by the spring force of the spring 7. Thereafter, the ejector lever can be rotated by a non-illustrated electrical drive sufficiently slowly in the case of FIG. 3 in an anti-clockwise direction and thus lowered. The electrical drive can be started up by a non-illustrated sensor or microswitch by the sensor or microswitch, for example, querying the position of the blocking lever 3 and being activated as soon as the blocking lever 3 has left its blocking position. This slow, controlled lowering by an electrical drive also has the advantage that in the closed state the gap or the joint can be minimized which then remains between the hood and the adjacent chassis.

FIG. 4 shows a top view of the reverse compared to FIGS. 1 to 3, which illustrates further details. A spring 9 is braced with a leg on a wall 10 and with the other leg on the control lever 6. By means of the spring 9 following a deflection of the control lever 6 together with the blocking lever 3 it can be pivoted back into the starting position, i.e. in the protective position (in the case of FIG. 4 in an anti-clockwise direction). To enable the control lever 6 and the blocking lever 3 to be moved together back into the protective position, a lever arm 11 of the control lever 6 is adjacent to the bent-off flap 12 of the impact protector or blocking lever 3. If the control lever 6 in the case of FIG. 4 is pivoted in an anti-clockwise direction, this rotary movement is transmitted by the arm 11 and the flap 12 acting as a stop onto the blocking lever 3.

The control lever 6 has an installation area 13 which is adjacent to one or both arms of the catch 1 when the catch is pivoted into its main ratchet position. FIG. 4 shows the case where the catch 1 has reached its main ratchet position. By adjacency in the installation area 13 noises and mechanical stresses are prevented.

FIG. 4 illustrates that the locking bolt 5 is capable of being supported on a free lever end of the ejector lever 14. By pivoting in an anti-clockwise direction (in the case of FIG. 4) the ejector lever 14 can lift the hood again following an unratcheting of the locking mechanism. This can occur by means of spring force. A non-illustrated electrical drive can pivot the ejector lever 14 alternatively or additionally in one design.

FIGS. 5-12 show a further execution form of the invention. FIG. 5 shows an open locking mechanism of this further design. FIGS. 6-10 show a sequence of movements of the locking mechanism during closure of a pertaining hood. FIG. 11 shows the ratcheted locking mechanism when the hood is closed. FIG. 12 shows the locking mechanism in which the catch 1 is in an overstroke position.

The locking mechanism shown in FIGS. 5 to 12 comprises a catch 1 and a pawl 16. The pawl 16 can be pivoted around its axis 17. The pawl 16 comprises a ratchet hook 18 which can be ratcheted with a ratchet hook 19 of the catch 1. The pawl 16 demonstrates a control arm 20 with which a speed-dependent pivoting of the blocking lever 3 is controlled. The control arm 20 demonstrates an extended construction which with the blocking lever 3 primarily includes a right angle when the locking mechanism is in the open position as shown in FIG. 5.

There is a hood latch arresting hook 21 which can be pivoted around the axis 4. The hood latch arresting hook 21 possesses an entrance incline 22 which the locking bolt 5 initially strikes as shown in FIG. 1 when the pertaining hood is closed. If the hood and thus the locking bolt 5 is lowered further, the locking bolt 5 initiates a torque into the hood latch arresting hook 21 via the entrance incline 22. Consequently, the hood latch arresting hook 21 can be pivoted around the axis 4 in a clockwise direction. The hood latch arresting hook 21 can thus intercept the force of a first impact during closure of a hood. The entrance incline 22 forms the upper side of a hook 23. The hook 23 prevents a hood being able to open in an unscheduled manner when the locking bolt 5 has passed the area of the hook 23 and has been moved into the locking mechanism. If the locking bolt 5 has passed the area of the hook 23, the locking bolt 5 strikes a bracket-shaped protruding control contour 24, as shown in FIG. 6. As a result, an impact during closure is further prevented. Furthermore, by means of the control contour 24 the hood latch arresting hook 21 is pivoted back around the axis 4 in an anti-clockwise direction until the position shown in FIG. 7 is attained, in which the locking bolt 5 strikes the collecting arm 28 of the catch 1. FIG. 7 further illustrates that now the locking bolt 5 cannot be moved out of the locking mechanism because it is prevented from doing so by the hook 23. The locking bolt is now located in an infeed section 25 of a plate 26 preferably made of metal to which the locking mechanism is attached.

The locking bolt 5 can only be moved out of the locking mechanism when the hood latch arresting hook 21 is suitably pivoted around the axis 4 again in a clockwise direction. This can be activated manually or electrically.

In principle, the hood latch arresting hook 21 is pre-tensioned by a spring in such a way that the hood latch arresting hook 21 can be pivoted by spring force in an anti-clockwise direction.

If the locking bolt 5 is moved further into the infeed section 25, the catch 1 is thus pivoted around its axis 2 in an anti-clockwise direction. The locking bolt 5 strikes a further control contour 27 of the hood latch arresting hook as shown in FIG. 8. By means of the further control contour 27 the hood latch arresting hook 21 is in principle pivoted against the force of a pre-tensioned spring around the axis 4 as a consequence of the further lowering of the hood and thus the further lowering of the locking bolt 5, whereby the lowering speed is further decelerated.

Starting from FIG. 8, a further lowering of the locking bolt 5 into the infeed section 25 causes the catch 1 to be pivoted further in an anti-clockwise direction and thus, in conjunction with this, the pawl 16 is now pivoted around its axis 17 in a clockwise direction for the following reason. The pawl 16 is pre-tensioned by a spring in the clockwise direction and can therefore be pivoted by spring force in a clockwise direction. The pawl 1 is pre-tensioned by a spring also in the clockwise direction and can therefore be pivoted by spring force in a clockwise direction. Now the catch 1 must be pivoted in an anti-clockwise direction by the latch holder or locking bolt 5 of the hood caused by closure of the hood. As shown in FIGS. 5 to 8, the free end of the collecting arm 28 is adjacent to the catch 1 on a control contour 29 of the pawl 16 which is bracket-shaped in places and retains the pawl 16 in the open position. The control contour 29 is formed as a protrusion. The bracket shape to the tip of the protrusion enables suitable gliding of the catch along the control contour 29. If the catch 1 becomes disengaged from the pawl 16 by further pivoting as illustrated in FIGS. 9 and 10 the pawl 16 is pivoted in a clockwise direction due to the spring pre-tensioning in a clockwise direction.

The control arm 20 of the pawl 16 for the blocking lever 3 is offset in such a way that the catch 1 can glide past it as shown in FIGS. 8 to 11. Starting from FIG. 8, the situation shown in FIG. 9 is initially reached and then the position shown in FIG. 10. In FIG. 9, the control arm 20 of the pawl 16 is still adjacent to the blocking lever 3, which prevents the blocking lever 3 relevantly pre-tensioned by a spring from leaving its blocking position. This changes during the transition to the position according to FIG. 10. Here, the control arm 20 now releases the blocking lever 3. Consequently, the blocking lever can now be pivoted by the force of a pre-tensioned spring in an anti-clockwise direction around its axis 4.

If the pawl 16 has been pivoted excessively fast around its axis 17 in a clockwise direction, the blocking lever 3 cannot be moved or cannot be moved quickly enough out of its blocking position. It then strikes the locking bolt 5 on the blocking lever 3 which prevents the locking bolt 5 being able to be moved further into the infeed section 25. An impact protector is thus ready.

FIG. 11 shows the situation after the blocking lever 3 is moved out of its blocking situation due to its pre-tensioned spring, i.e. is pivoted around its axis 4 in an anti-clockwise direction. Only such a pivoting of the blocking lever 3 enables further lowering (plunging) of the locking bolt 5 into the infeed section 25 in order to enable an impacting or plunging as shown in FIG. 12. Both ratchet hooks 18 and 19 ratchet into one another, whereby a pivoting of the catch 1 in the clockwise direction is prevented. Starting from the ratcheted position, the catch 1 can also attain an overstroke position, as shown in FIG. 12. This overstroke position enables lowering of the hood and acts as pedestrian protection in order to minimize the impact of a pedestrian onto the pertaining hood in the event of an accident.

The hood latch arresting hook 21 is suitably designed in such a way that the hood with its locking bolt 5 can plunge in the closed position (see FIG. 12). The hood latch arresting hook 21 itself does not intercept any impact of a pedestrian on the hood, but allows the locking bolt 5 to plunge in the closed state of the hood during an impact.

If the hood is closed too quickly, the locking bolt 5 impacts on the blocking lever 3.

An unwanted opening of the hood, for example due to failure of the main ratchet, is prevented by the hood latch arresting hook 21.

At the same time, the hood latch arresting hook 21 prevents the hood springing up after intentional opening. Consequently, the last opening step is performed manually, for example.

FIGS. 8 to 11 illustrate that the control arm 20 is outside of the plane within which the catch 1 can be rotated.

The load arm of the catch which encompasses the hook 19 is considerably shorter than the collecting arm 20 as the collecting arm 20 needs to reach to the control contour 29 on the one hand and on the other hand the load arm must be short enough for the locking bolt 5 to reach into the locking mechanism.

With the exception of the control arm 20, the catch 1 and the pawl 16 are in a common plane. The blocking lever and the control arm are in a common plane, for example as shown in FIGS. 5 to 12 before the catch 1. In a third plane, the hood latch arresting hook 21 is thus located, for example, as shown in FIGS. 5 to 12 behind the catch 1 and the pawl 16.

If, starting from the ratcheted position, the pawl 16 is moved out of its ratcheted position, the catch 1 is thus released. The catch 1 can then pivot into its open position in a clockwise direction. The control arm 20 then pivots the blocking lever 3 back into its impact-protecting position.

REFERENCE SIGN LIST

1: Catch
2: Axis for the catch
3: Blocking lever/impact protector
4: Axis for the blocking lever impact protector
5: Locking bolt
6: Control lever
7: Spring for connection of the control lever to the impact protector
8: free end of the control lever
9: Spring
10: Wall
11: Lever arm of the control lever
12: Flap of the blocking lever
13: Installation area of the control lever
14: Ejector lever
15: Ejector lever axis
16: Pawl
17: Axis for the pawl
18: Ratchet hook for the pawl
19: Ratchet hook for the catch
20: Control arm for the pawl
21: Hood latch arresting hook
22: Hood latch arresting hook—entrance incline
23: Hook
24: Bracket-shaped control contour
25: Infeed section
26: Plate
27: Further hood latch arresting hook—control contour
28: Collecting arm of the catch
29: Control contour of the pawl

The invention claimed is:

1. A latching device for a door or flap of a motor vehicle comprising:

a locking mechanism comprising a catch and at least a pawl for latching of the catch;

a control lever pivotably mounted on a common axis; and an impact protector pivotably mounted adjacent the control lever on the common axis and connected to the control lever by a spring, the impact protector having a mass that is greater than a mass of the control lever, wherein when the door or flap is closed at a speed below a threshold value, the catch is pivoted at the speed below the threshold value into direct engagement against the control lever to pivot the control lever, and the control lever and the impact protector are pivoted jointly around the common axis via the spring connected therebetween, the impact protector being moved out of a protective position in which the impact protector is configured to absorb an impact on the latch device to prevent damage to the latching device, and wherein when the door or flap is closed at a speed above the threshold value, the catch is pivoted at the speed above the threshold value into direct engagement against the control lever to pivot the control lever, and the impact protector is maintained in the protective position via inertia of the mass of the impact protector.

2. The latching device according to claim 1, wherein the control arm is part of the pawl of the locking mechanism.

3. The latching device according to claim 1, wherein the control arm is outside of the plane within which the catch is rotated.

4. The latching device according to claim 1, wherein the impact protector is a pivotable blocking lever.

5. The latching device according to claim 1, wherein the control arm with the blocking lever primarily includes a right angle when the locking mechanism is open.

6. The latching device according to claim 1, wherein the catch is initially adjacent to the pawl during closure and subsequently releases the pawl whereby the pawl is pivotable into the ratchet position.

7. The latching device according to claim 6, wherein an arm of the catch is adjacent to a control contour of the pawl.

8. The latching device according to claim 7, wherein the control contour is formed by a protrusion.

9. The latching device according to claim 1 further comprising a hood latch arresting hook which is pivoted following unratcheting of the locking mechanism for opening a pertaining door or flap.

10. The latching device according to claim 9, wherein the impact protector and the hood latch arresting hook are pivotably located by a common axis.

11. The latching device according to claim 9, wherein the hood latch arresting hook is pivoted backwards and forwards during closure.

12. The latching device according to claim 1, wherein the catch has an overstroke position into which the catch is configured to move when the catch moves past the ratcheted position, wherein a pertaining hood is further lowered by at least 10 mm when the catch moves to the overstroke position.

13. A motor vehicle with a hood which is configured to receive an impact that moves the locking mechanism past a main ratchet position, the motor vehicle encompassing a latching device according to claim 1.

* * * * *